US005713145A

United States Patent [19]

Ruvang

[11] Patent Number: 5,713,145

[45] Date of Patent: Feb. 3, 1998

[54] WEAR RESISTANT EXCAVATING APPARATUS

[75] Inventor: John A. Ruvang, Carrollton, Tex.

[73] Assignee: GH Hensley Industries, Inc., Dallas, Tex.

[21] Appl. No.: 622,445

[22] Filed: Mar. 12, 1996

[51] Int. Cl.[6] ..... E02F 9/28

[52] U.S. Cl. ..... 37/458; 37/455

[58] Field of Search ..... 37/446, 448–458; 403/374, 379

[56] References Cited

U.S. PATENT DOCUMENTS

| | | | |
|---|---|---|---|
| 1,485,879 | 3/1924 | Page | 37/455 |
| 1,868,247 | 7/1932 | Page | 37/458 |
| 2,167,425 | 7/1939 | Page | 37/452 |
| 2,385,395 | 9/1945 | Baer | 37/458 |
| 3,371,437 | 3/1968 | Wilson et al. | 37/455 |
| 3,845,578 | 11/1974 | Holmstrom | 37/453 X |
| 4,187,035 | 2/1980 | Colburn | 37/458 X |
| 4,205,469 | 6/1980 | Johansson et al. | 37/457 |
| 4,716,667 | 1/1988 | Martin | 37/142 R |
| 4,748,754 | 6/1988 | Schwappach | 37/453 X |
| 5,177,886 | 1/1993 | Klett | 37/452 |
| 5,410,826 | 5/1995 | Immel et al. | 37/457 |

*Primary Examiner*—Terry Lee Melius
*Assistant Examiner*—Victor Batson
*Attorney, Agent, or Firm*—Konneker & Smith, P.C.

[57] ABSTRACT

A wear resistant excavating apparatus provides reduced wear, resilient compensation for such wear, reduced time required for installation, maintenance, and repair, and reduced hazards of operation. In a preferred embodiment, a wear resistant excavating apparatus has a lip which penetrates the earth, a structure which overlaps the lip, a fastener which biases the overlapping structure to contact the lip, and a compression member which resiliently maintains the overlapping structure in contact with the lip.

19 Claims, 4 Drawing Sheets

WEAR RESISTANT EXCAVATING APPARATUS

BACKGROUND OF THE INVENTION

The present invention relates generally to excavating apparatus and, in a preferred embodiment thereof, more particularly provides a wear resistant excavating apparatus.

Large excavating buckets, dippers, or the like are typically provided with a series of earth-cutting teeth which are each formed from two primary parts—a relatively large adapter and a relatively small replaceable point. The adapter has a base portion which is connectable to the forward lower lip of the bucket and a nose portion onto which the tooth point is removably secured by a suitable connecting pin. Compared to that of the adapter, the useful life of the point is rather short—the adapter typically lasting through five or more point replacements until the tremendous earth forces and abrasion to which it is subjected necessitates its replacement.

Usually the teeth on the forward lip portion of the bucket are spaced apart from each other. To protect the otherwise exposed forward lip portion of the bucket in the spaces between the teeth from impact and abrasion, protective coverings known as "shrouds" are commonly affixed to the forward lip portion. Essentially, the shrouds wrap around the forward lip portion and serve as sacrificial wear members, absorbing the impact and abrasion from the earth penetrated by, and passing to either side of, the teeth. The shrouds may be removably mounted to the bucket in the same manner as the adapters, or other methods may be utilized for mounting the shrouds.

A typical method of mounting adapters and shrouds to a bucket is to form a series of holes vertically through the forward lip portion of the bucket. Corresponding holes are formed vertically through the adapters and shrouds, and, with the adapters and shrouds in place on the forward lip portion, the corresponding holes are aligned and wedges are driven therethrough. Properly configured, the wedges may not only secure the adapters and shrouds to the bucket, but also rearwardly bias the adapters and shrouds against the forward lip portion to prevent relative motion and impact therebetween when the bucket penetrates the earth.

There are, however, many disadvantages of the above-described wedge method of mounting adapters and shrouds to an excavating bucket. In the first instance, the wedge method removes material from the forward lip portion by forming a series of holes through the bucket. This weakens the forward lip portion and provides further surfaces for wear to occur.

Another disadvantage is that when the adapters, shrouds, and contact surfaces between these and the forward lip portion to which they are mounted do begin to wear, gaps are formed therebetween. Thereafter, each time the excavating bucket engages the earth the adapters and shrouds impact the forward lip portion. Also, the earth is permitted to flow into the gaps between the contact surfaces and abrade the contact surfaces. Thus, as soon as gaps are formed between the contact surfaces, impact and abrasion wear of the adapters, shrouds, and forward lip portion are accelerated.

Gaps between the contact surfaces are frequently caused initially by loosening of the wedges installed in the shrouds and adapters. Various methods have been proposed to prevent such loosening of the wedges, including ratchet and pawl mechanisms, resilient biasing devices, and others, but none have been entirely successful.

A further disadvantage of the wedge method is that it does not adequately prevent relative vertical displacement between the rear of the shrouds and adapters, and the bucket lip. Thus, although the wedges initially rearwardly bias the adapters and shrouds against the forward lip portion to prevent horizontally directed impact between the bucket and the shrouds and adapters, vertically directed impact therebetween is not affected. Various methods have been proposed to prevent such vertically directed impact, including providing C-clamps to vertically clamp the shrouds and adapters to the bucket lip when the wedges are installed. However, the C-clamps depend upon the wedges for their clamping force and when the wedges loosen, so do the C-clamps.

Yet another disadvantage of the wedge method is that the wedges do not prevent side-to-side displacement of the bucket lip relative to the shrouds and adapters. If C-clamps are provided, and if the C-clamps retain adequate clamping force, relative side-to-side displacement will be somewhat restricted, but, as noted above, the C-clamps will not retain adequate clamping force when the wedges are loosened.

A further disadvantage of the wedge method is that it is hazardous. The wedges, shrouds, and adapters are typically made of cast material. When the wedges are hammered into place, it is common for pieces of the wedges, shrouds and adapters to chip off, presenting a hazard for any person in the immediate area.

Another disadvantage of the wedge method is that it is time-consuming to replace an adapter or shroud on the forward lip portion. In each instance the wedge retaining mechanism or device, if utilized, must be disengaged, the wedge must be driven out of the corresponding holes, the C-clamp, if utilized, must be removed, the adapter or shroud must be removed from the bucket lip, and a new C-clamp, wedge, retaining mechanism or device, and adapter or shroud installed.

Yet another disadvantage of the wedge method is that it is time-consuming to repair and rebuild the forward lip portion when it has been worn away by impact and abrasion. Typically, the holes through the bucket have been enlarged and must be reduced by welding and reformed by machining. The contact surfaces between the bucket lip and the adapters and shrouds have typically been worn down and must be built back up by welding and then ground or machined down to proper profiles. Additionally, such repair and rebuilding operations are commonly performed at an excavation site in conditions that are less than ideal for precision machining.

From the foregoing, it can be seen that it would be quite desirable to provide a wear resistant apparatus for an excavating bucket which does not require forming holes through the bucket lip, which does not contribute to accelerated wear of the forward lip portion when the adapters and shrouds begin to wear, which does not loosen due to impact or wear between contact surfaces, which prevents relative vertical and side-to-side movement between the bucket lip and the adapters and shrouds, which does not require hammering for its installation, and which may be relatively quickly replaced. It is accordingly an object of the present invention to provide such a wear resistant apparatus for an excavating bucket.

SUMMARY OF THE INVENTION

In carrying out the principles of the present invention, in accordance with an embodiment thereof, a wear resistant excavating apparatus is provided which is an excavating device having a removable wear resistant attachment mounted to a forward lip portion thereof, utilization of which does not require forming one or more holes in the forward lip portion, but which permits the wear resistant attachment to be conveniently mounted, replaced, and repaired, and which has additional features that reduce wear and movement of the attachment relative to the forward lip portion.

In broad terms, a wear resistant attachment is provided for an excavating device having an earth penetrating lip, the lip having a top surface, a bottom surface, and an edge, and one of the top and bottom surfaces having a retainer mounted thereto. The attachment includes a generally C-shaped body having a profile internally formed thereon and a fastener attachment portion, the profile being shaped to complementarily receive the lip therein, a fastener having opposite ends, one of the opposite ends being attached to the fastener attachment portion and the other of the opposite ends being attachable to the retainer, and a resilient biasing member attached to the fastener and capable of biasing the profile to contact the lip when the fastener is attached to the retainer. The body may be conveniently maintained on the lip with the profile in resiliently biased contact with the lip.

An excavating bucket for releasable securement of wear resistant attachments thereto is also provided. Each of the attachments includes a generally C-shaped body having opposite ends, a first recess internally formed intermediate the opposite ends, and a second recess internally formed adjacent one of the opposite ends and extending laterally inwardly therefrom. An elongated fastener is attached to each attachment.

The excavating bucket comprises a forward lip portion having top and bottom sides and an edge, the forward lip portion being complementarily engageable within the C-shaped bodies of the attachments, a series of laterally spaced apart and generally C-shaped locator structures mounted to the edge and extending laterally outwardly therefrom, each of the locator structures being receivable within one of the first recesses and restricting lateral movement of one of the attachments relative to the forward lip portion when the forward lip portion is complementarily engaged within the C-shaped bodies of the attachments, and a series of laterally spaced apart retainer structures mounted to one of the forward lip portion top and bottom sides, each of the retainer structures having a laterally extending side portion formed thereon, each of the side portions being receivable within one of the second recesses and restricting lateral and orthogonally outward movement of one of the ends of the attachments relative to the forward lip portion when the forward lip portion is complementarily engaged within the C-shaped bodies of the attachments.

Also provided is a wear resistant excavating apparatus, which includes lip means for penetrating an abrasive material. The lip means has top and bottom sides and a forward edge. The apparatus further includes means for overlapping the lip means, the overlapping means reducing wear of the lip means at least by reducing contact between the lip means and the abrasive material, means attached to the lip means and the overlapping means for biasing the overlapping means against the forward edge, and means attached to the biasing means for resiliently maintaining a force biasing the overlapping means against the lip means, such that the force is maintained when wear is produced between the overlapping means and the lip means.

The use of the disclosed wear resistant excavating apparatus substantially reduces wear of an earth engaging device due to abrasion and impact. When such wear does occur, the apparatus is capable of compensating for the wear, thereby reducing accelerated wear due to impact between the components of the apparatus.

DETAILED DESCRIPTION

Figure 1:
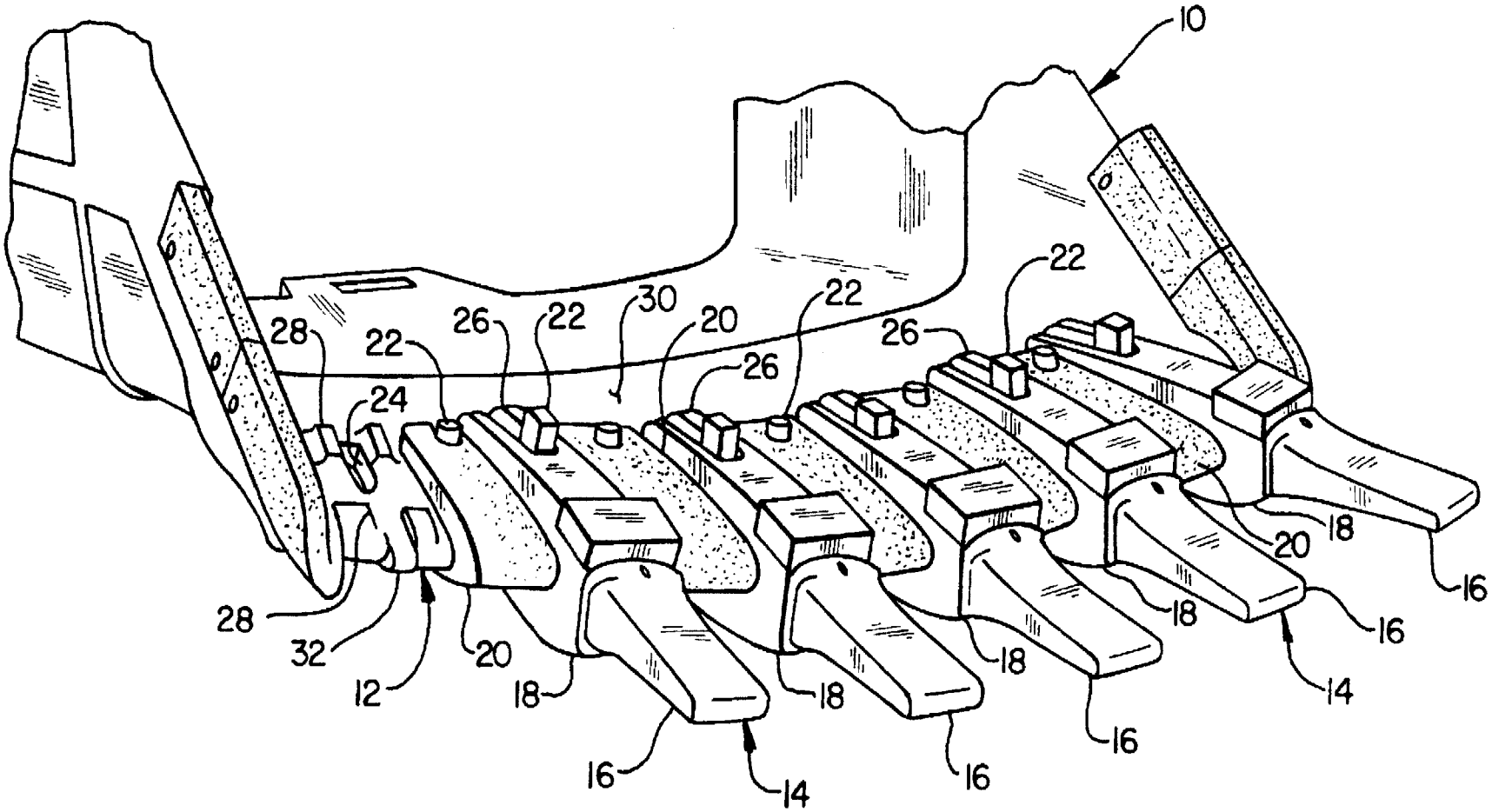
FIG. 1 (PRIOR ART)
FIG. 1 (Prior Art) is a top perspective view of an excavating bucket having a plurality of prior art shrouds and adapters mounted to a forward lip portion of the bucket.

Illustrated in FIG. 1 (Prior Art) is a forward, earth penetrating, portion of an excavating bucket 10. A forward lip portion 12 of the excavating bucket 10 is fitted with a laterally spaced apart series of teeth 14, each of which includes a point 16 suitably connected to an adapter 18. One such tooth 14 is representatively removed from the bucket 10. Each pair of adapters 18 are separated by a shroud 20 which overlaps the forward lip portion 12.

The adapters and shrouds 18 and 20 are releasably secured to the forward lip portion 12 by wedges 22 driven through holes 24 (only one of which is visible in FIG. 1) formed vertically through the forward lip portion 12. As representatively illustrated in FIG. 1, each of the adapters 18 also has a C-clamp 26 installed therethrough for vertically clamping the adapter to the forward lip portion 12.

The forward lip portion 12 has a series of four laterally spaced apart contact surfaces 28 formed on an upper side 30 thereof for each of the adapters 18 and shrouds 20. Such contact surfaces 28 may also be formed on a bottom side 36 (see FIG. 2) of the forward lip portion 12.

A projection 32 extends forwardly from the forward lip portion 12 for each of the adapters 18 and shrouds 20 to prevent side-to-side movement of the adapters and shrouds relative to the forward lip portion. Each of the projections 32 extend laterally into a complementarily shaped recess 34 (see FIG. 2) formed within one of the adapters or shrouds 18,20.

Figure 2:
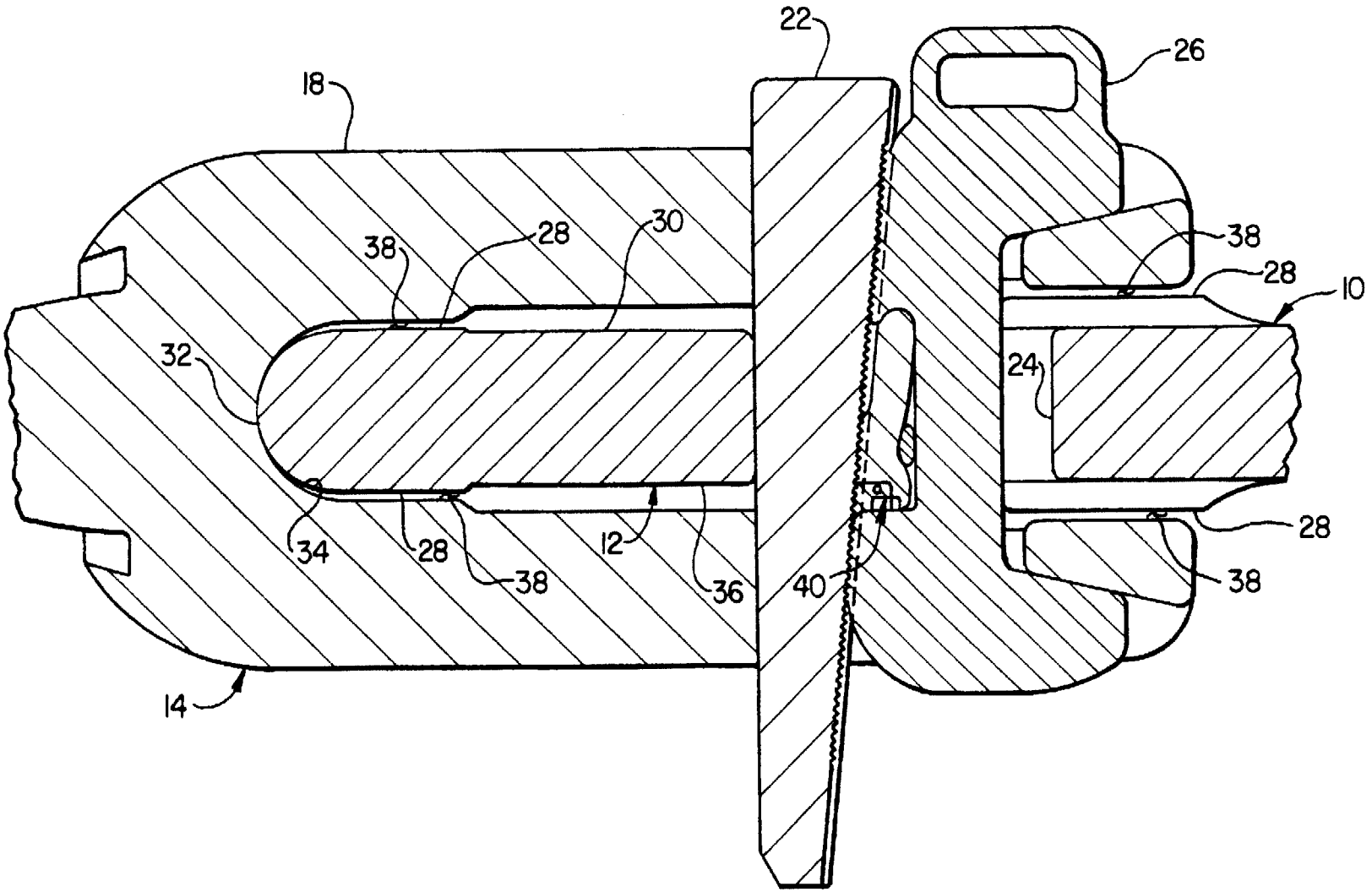
FIG. 2 (PRIOR ART)
FIG. 2 (Prior Art) is an enlarged scale cross-sectional view through a prior art adapter mounted to the forward lip portion of the bucket of FIG. 1.

Turning now to FIG. 2, a lateral cross-sectional view is shown of one of the adapters 18 installed on the forward lip portion 12. FIG. 2 representatively illustrates the adapter 18 and forward lip portion 12 after some wear has occurred on each. Note that gaps 38 are present between the adapter 18 and the contact surfaces 28 on the top and bottom sides 30 and 36 of the forward lip portion 12. No gap is seen between the projection 32 and the recess 34, because the wedge 22 has been driven downwardly each time such a gap has been formed, the wedge as shown being at the end of its permissible downward travel. Further wear of the projection 32 or recess 34 cannot be compensated for by further downward displacement of the wedge 22.

Note that, as representatively illustrated, the adapter 18 is permitted to displace vertically relative to the forward lip portion 12. The C-clamp 26 is no longer able to vertically clamp the adapter 18 to the forward lip portion 12, because the wedge 22 cannot be driven further downward. A ratchet and pawl retaining mechanism 40 is provided, which acts to prevent vertically upward movement of the wedge 22 relative to the C-clamp 26, but which does not itself maintain a rearwardly biasing force between the wedge and the forward lip portion 12. Note that, since the wedge 22 may not be driven further downward, if projection 32 and/or recess 34 wear sufficiently, the mechanism 40 may disengage, permitting the wedge to dislodge from the adapter 18.

Figure 3:
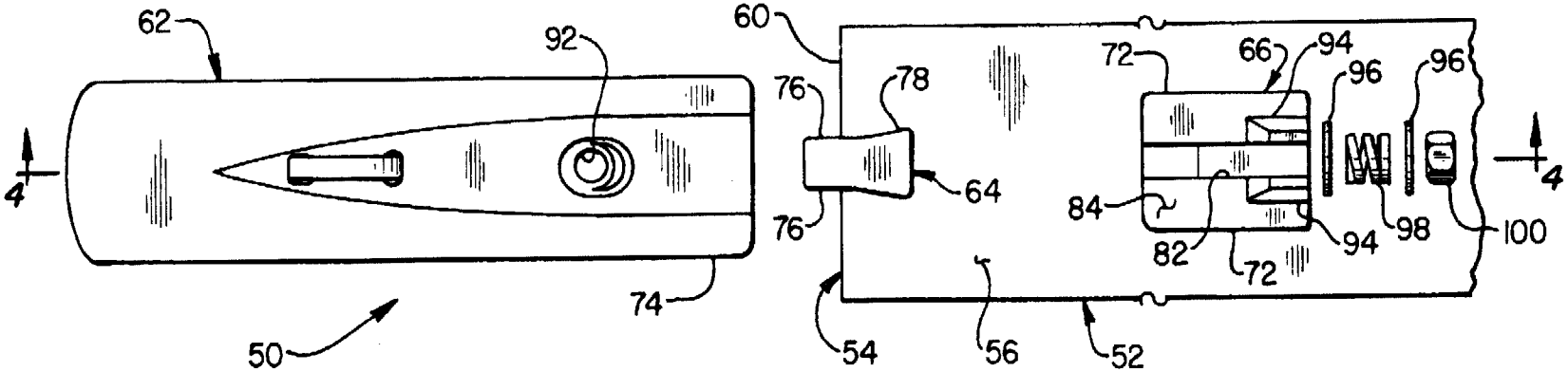
FIG. 3 is a top plan view of a wear resistant shroud and a forward lip portion of an excavating bucket, the shroud and bucket incorporating principles of the present invention.
Figure 4:
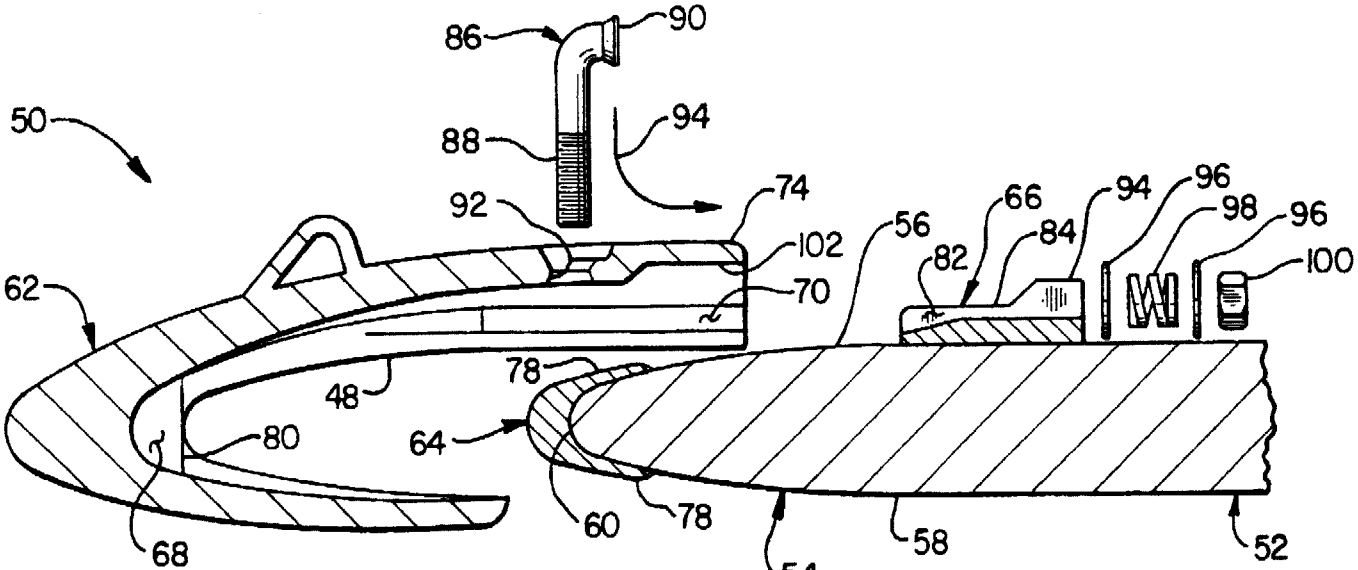
FIG. 4 is a cross-sectional view of the wear resistant shroud and bucket forward lip portion of FIG. 3, taken along line 4—4 of FIG. 3.

Turning now to FIGS. 3 and 4, a wear resistant excavating apparatus 50 embodying principles of the present invention is representatively illustrated. FIG. 4 shows a cross-sectional view of the apparatus 50, taken along line 4—4 of FIG. 3. In the following description of the apparatus 50, terms such as "upward", "downward", "forward", and "rearward" are used in relation to the apparatus as it is representatively illustrated in the accompanying figures. It is to be understood, however, that the apparatus 50 may be utilized in orientations other than that depicted in the accompanying figures.

The apparatus 50 includes an excavating bucket 52 having a forward, earth penetrating, lip portion 54. It is to be understood that the excavating bucket 52 may alternately be a shovel, dipper, or other excavating device without departing from the principles of the present invention. As representatively illustrated, the lip portion 54 is generally planar and extends laterally and horizontally across the excavating bucket 52. The lip portion 54 has a top side 56, a bottom side 58, and a forward edge 60. The top and bottom sides 56, 58 taper inwardly toward the forward edge 60.

The apparatus 50 also includes a specially designed shroud 62 which protects the top side 56, bottom side 58, and forward edge 60 of the lip portion 54 from wear due to, for example, abrasion produced by flow of earth thereover and impact produced by forcibly penetrating the earth. The shroud 62, in essence, wraps over the forward edge 60 from the top side 56 to the bottom side 58 and, thus, is generally C-shaped. As representatively illustrated, the shroud 62 has two laterally spaced apart inner profiles 48 formed thereon (only one of which is visible in FIG. 4) which complementarily engages the lip portion 54.

In the apparatus 50, the shroud 62, lip portion 54, and other elements which will be described hereinbelow, are specially designed for secure attachment of the shroud to the lip portion and rapid replacement of the shroud and other elements. It is to be understood that there may be multiple shrouds 62 on the lip portion 54, and that the shroud may be an adapter or other attachment to the excavating bucket 52 without departing from the principles of the present invention.

For securement of the shroud 62 to the lip portion 54, a locator 64 and a retainer 66 are welded to the lip portion such that they are laterally aligned with complementarily shaped recesses 68 and 70, respectively, internally formed on the shroud. Thus, when shroud 62 is laterally moved into engagement with the lip portion 54, two opposing laterally extending recesses 70 (only one of which is visible in FIG. 4) cooperatively engage two opposing laterally extending side portions 72 of the retainer 66, and the recess 68 cooperatively engages the forwardly extending locator 64. Such cooperative engagement of the recesses 70 with the side portions 72 prevents lateral side-to-side displacement of the shroud 62 relative to the lip portion 54, and also prevents vertical displacement of rear portion 74 of the shroud relative to the lip portion. Cooperative engagement of the recess 68 with the locator 64 prevents lateral side-to-side displacement of the shroud 62 relative to the lip portion 54. It is to be understood that locator 64 and retainer 66 may be secured to the lip portion 54 by methods other than welding without departing from the principles of the present invention.

Locator 64 is generally C-shaped and wraps around the forward edge 60 from top side 56 to bottom side 58 of the lip portion 54. Locator 64 includes opposing lateral sides 76 and flared leg portions 78, each of the leg portions overlying one of the top and bottom sides 56,58. Lateral sides 76 provide contact surfaces for engagement with opposing lateral sides 80 (only one of which is shown in FIG. 4) of the recess 68. Leg portions 78 are flared to provide increased weld area.

Retainer 66 has a channel 82 laterally formed therethrough, the channel extending downwardly from an upper surface 84 of the retainer. A generally J-shaped bolt 86 (not shown in FIG. 3) having threads 88 formed on one opposite end and a radially enlarged head 90 formed on the other opposite end is vertically inserted through an opening 92 formed vertically through the rear portion 74 of the shroud 62 and rotated in the direction indicated by arrow 94 until the threaded end 88 is generally horizontal. Head 90 is radially larger than opening 92 and is, thus, prevented from passing therethrough. In this manner, the bolt 86 is horizontally received in the channel 82 when the shroud 62 is laterally installed onto the lip portion 54.

Retainer 66 also includes two vertically extending abutments 94 formed on upper surface 84, the abutments straddling the channel 82. The abutments 94 provide vertical contact surfaces for two washers 96, a compression member 98, and a nut 100. Abutments 94 are received in recess 102 internally formed on the shroud 62 when the shroud is laterally installed onto the lip portion 54.

When the bolt 86 is received in the channel 82, the washers 96, compression member 98, and nut 100 are installed on threaded end 88 as shown, the washers straddling the compression member and the nut being installed lastly thereon. As will be more fully described hereinbelow, the nut 100 is tightened onto the threaded end 88 to rearwardly bias the shroud 62 against the lip portion 54 and to compress compression member 98 so that, as the shroud and/or lip portion wear, the shroud will be resiliently maintained rearwardly biased against the lip portion.

As will be readily appreciated by one skilled in the art, compression member 98 is representatively illustrated as a spirally wound spring, but may alternatively be any member capable of resiliently biasing the bolt 86 rearwardly, such as one or more bellville washers, an elastomeric member, etc. It is to be understood that an otherwise-shaped fastener (i.e., having other than a generally J-shape) and cooperatively shaped retainer may be utilized for releasably securing the shroud 62 to the lip portion 54 without departing from the principles of the present invention. For example, shroud 62 may have threads internally formed thereon and a straight bolt may be received in a retainer and tightened into the internally formed threads to rearwardly bias the shroud.

Figure 5:
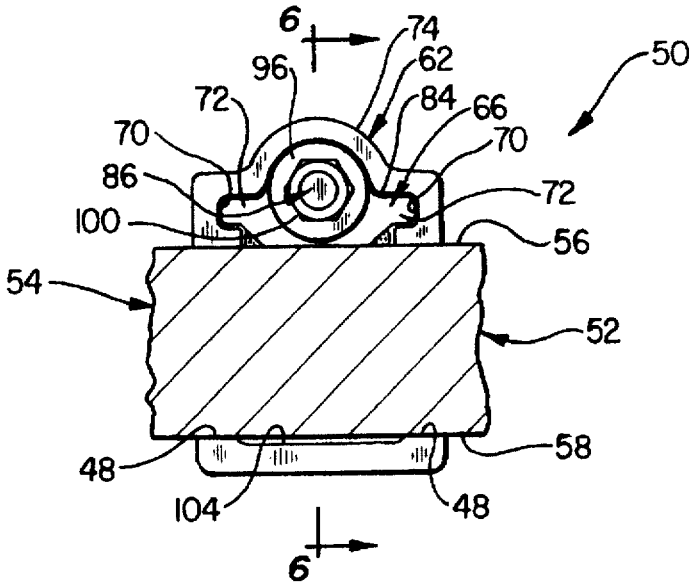
FIG. 5 is a rear elevational view of the wear resistant shroud of FIG. 3, the wear resistant shroud being operatively installed onto the bucket forward lip portion of FIG. 3.
Figure 6:
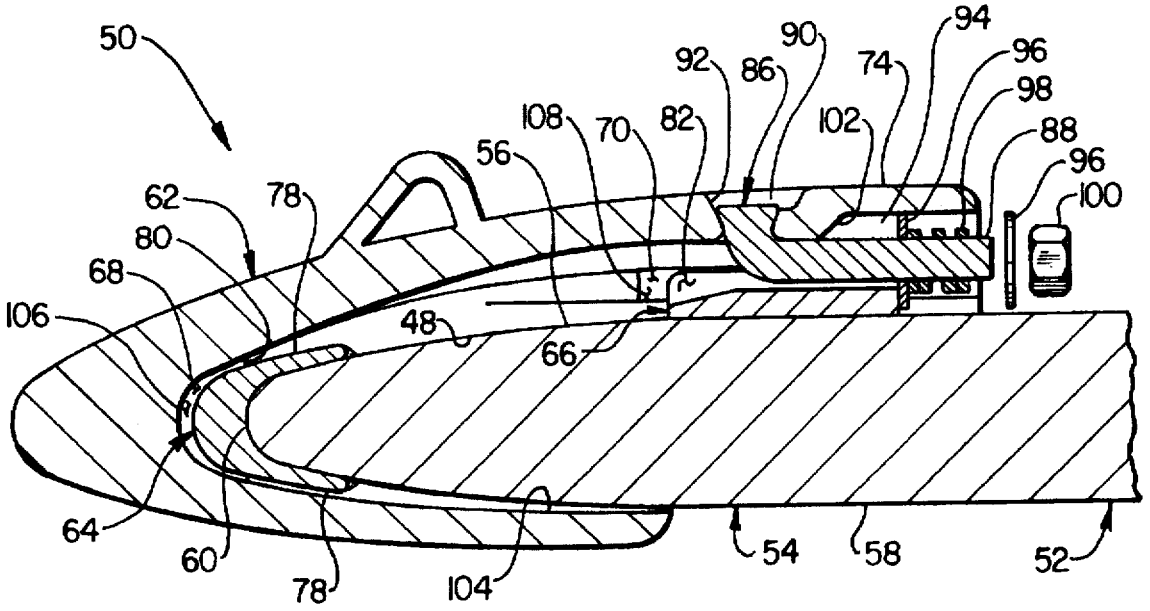
FIG. 6 is a cross-sectional view of the wear resistant shroud and bucket forward lip portion, taken along line 6—6 of FIG. 5.

Referring additionally now to FIGS. 5 and 6, the apparatus 50 is shown with the shroud 62 installed onto the lip portion 54. FIG. 5 shows a rear view of the apparatus 50 and FIG. 6 shows a cross-sectional view, taken along line 6—6 of FIG. 5.

FIG. 5 clearly shows the manner in which the retainer side portions 72 are received in the recesses 70 formed on the shroud 62. It will be readily appreciated that the cooperative engagement between the side portions 72 and recesses 70 restricts lateral side-to-side and vertically upward and downward displacement of the rear portion 74 of the shroud 62 relative to the lip portion 54. In this view the manner in which the inner profiles 48 formed on the shroud 62 complementarily engage the lip portion 54 may also be clearly seen. It will be readily appreciated that the cooperative engagement between the inner profiles 48 and the lip portion 54 further restrict vertically upward and downward displacement of the shroud 62 relative to the lip portion 54, and provide a positive stop for the rearward biasing of the shroud when the nut 100 is tightened onto the bolt 86. A recess 104 internally formed on the shroud 62 laterally intermediate the inner profiles 48 ensure that the inner profiles engage the lip portion 54 at the outer lateral edges of the shroud for increased stability.

FIG. 6 shows the apparatus 50 completely assembled, except that one of the washers 96 is yet to be installed on the threaded end 88 of the bolt 86, and the nut 100 is yet to be tightened on the bolt. It will be readily apparent that such tightening of the nut 100 on the bolt 86 will rearwardly bias the shroud 62 against the lip portion 54, forcing the inner profiles 48 to contact the top side 56, bottom side 58, and forward edge 60 of the lip portion. It will also be readily apparent that such tightening of the nut 100 on the bolt 86 will compress the compression member 98, so that if elements of the apparatus 50 wear, such as the inner profiles 48, top side 56, bottom side 58, or forward edge 60, the shroud 62 will remain resiliently rearwardly biased against the lip portion 54.

Note that gaps 106 and 108 are respectively provided laterally between the locator 64 and the recess 68, and laterally between the retainer 66 and the recess 70, so that the shroud 62 may laterally rearwardly displace somewhat as the apparatus 50 wears. Applicant prefers that gaps 106 and 108 permit approximately one-half inch laterally rearward displacement of the shroud 62 relative to the lip portion 54, although other displacements may be permitted without departing from the principles of the present invention. Recess 102 also permits such displacement, although the spatial relationship of the abutments 94 relative to the recess 102 is not visible in FIG. 6.

Thus has been described a wear resistant excavating apparatus 50 which does not require forming holes through the lip portion 54, which prevents accelerated wear of the shroud 62 and lip portion due to wear by resiliently biasing the shroud against the lip portion, which does not loosen due to impact or wear between contact surfaces, which restricts relative vertical and side-to-side displacement between the shroud and lip portion, which does not require hammering for its operation, maintenance, or replacement, and which may be relatively quickly replaced.

It is to be understood that where complementarily shaped elements have been described, either of the complementarily shaped portions of the elements may be internally or externally formed without departing from the principles of the present invention. For example, the shroud 62 may have laterally inwardly extending runners formed thereon instead of recesses 70, and retainer 66 may have recesses formed thereon which are complementarily shaped to the runners, instead of side portions 72.

The foregoing detailed description is to be clearly understood as being given by way of illustration and example only, the spirit and scope of the present invention being limited solely by the appended claims.

What is claimed is:

1. For an excavating device having an earth penetrating lip, the lip having a top surface, a bottom surface, and an edge, and one of the top and bottom surfaces having a retainer mounted thereto, the retainer having a laterally outwardly extending side portion formed thereon, a wear resistant attachment comprising:

a generally C-shaped body having a profile internally formed thereon and a fastener attachment portion, said profile being shaped to complementarily receive the lip therein;

a fastener having opposite ends, one of said opposite ends being attached to said fastener attachment portion and the other of said opposite ends being attachable to the retainer; and a resilient biasing member attached to said fastener and capable of biasing said profile to contact the lip when said fastener is attached to the retainer, said body further having a recess internally formed thereon, said recess being capable of cooperatively engaging the retainer side portion and restricting displacement of said body relative to the lip when said fastener is attached to the retainer, whereby the body may be conveniently maintained on the lip with said profile in resiliently biased contact with the lip.

2. The attachment according to claim 1, wherein the retainer has a channel laterally formed across a surface thereof, and wherein said fastener is cooperatively received in the channel when said fastener is attached to the retainer.

3. The attachment according to claim 1, wherein said fastener comprises a generally J-shaped bolt having a threaded end and a radially enlarged head end formed thereon, and wherein said body has an opening formed therethrough, said opening being radially smaller than said head end and radially larger than said threaded end, such that said fastener may be attached to said body by inserting said threaded end through said opening, and such that said fastener is attachable to the retainer by tightening a nut onto said threaded end.

4. The attachment according to claim 1, wherein said resilient biasing member comprises a compression member, said compression member being compressible when said fastener is attached to the retainer.

5. The attachment according to claim 4, wherein said compression member comprises a spring, and wherein said fastener comprises a bolt, said bolt being axially received in said spring when said fastener is attached to the retainer.

6. The attachment according to claim 5, wherein the retainer has a surface formed thereon generally orthogonal to the lip, and further comprising a nut, said nut compressing said spring intermediate said nut and the surface when said fastener is attached to the retainer.

7. An excavating bucket for releasable securement of a wear resistant attachment thereto, the attachment comprising a generally C-shaped body having opposite ends, a first recess internally formed intermediate the opposite ends, and a second recess internally formed adjacent one of the opposite ends and extending laterally inwardly therefrom, and the attachment further having an elongated fastener attached thereto, the excavating bucket comprising:

a forward lip portion having top and bottom sides and an edge, said forward lip portion being complementarily engageable within the C-shaped body of the attachment;

a generally C-shaped locator structure mounted to said edge and extending laterally outwardly therefrom, said locator structure being receivable within the first recess and restricting lateral movement of the attachment relative to said forward lip portion when said forward lip portion is complementarily engaged within the C-shaped body of the attachment; and a retainer structure mounted to one of said forward lip portion top and bottom sides, said retainer structure having a laterally extending side portion formed thereon, said side portion being receivable within said second recess and restricting lateral and orthogonally outward movement of the one of the ends of the attachment relative to said forward lip portion when said forward lip portion is complementarily engaged within the C-shaped body of the attachment.

8. Wear resistant excavating apparatus, comprising:

lip means for penetrating an abrasive material, said lip means having top and bottom sides and a forward edge;

means for overlapping said lip means, said overlapping means reducing wear of said lip means at least by reducing contact between said lip means and said abrasive material;

means attached to said lip means and said overlapping means for biasing said overlapping means against said forward edge;

means attached to said biasing means for resiliently maintaining a force biasing said overlapping means against said lip means, such that said force is maintained when wear is produced between said overlapping means and said lip means; and means attached to said lip means forward edge for restricting lateral movement of a forward portion of said overlapping means relative to said lip means.

9. The excavating apparatus according to claim 8, wherein said lateral movement restricting means comprises a member projecting forwardly from said forward edge and a recess internally formed on said overlapping means, said member being received in said recess.

10. The excavating apparatus according to claim 8, wherein said lip means comprises a forward lip portion of an excavating bucket.

11. The excavating apparatus according to claim 8, wherein said overlapping means comprises a shroud, said shroud covering a portion of said forward edge, a portion of said top side, and a portion of said bottom side of said lip means.

12. The excavating apparatus according to claim 8, wherein said biasing means comprises a fastener, said fastener being capable of applying said force to bias said overlapping means against said forward edge.

13. The excavating apparatus according to claim 12, wherein said fastener is an elongated externally threaded member, and wherein said biasing means further comprises an internally threaded member, said internally threaded member being tightened onto said externally threaded member to apply said force to bias said overlapping means against said forward edge.

14. The excavating apparatus according to claim 13, wherein said biasing means further comprises a retainer attached to said lip means, said retainer having a rearwardly facing surface formed thereon, said surface being orthogonal to one of said top and bottom sides, and wherein said externally threaded member is received in a first recess formed on said retainer and said internally threaded member applies said force to said surface when said internally threaded member is tightened onto said externally threaded member.

15. Wear resistant excavating apparatus, comprising:

lip means for penetrating an abrasive material, said lip means having top and bottom sides and a forward edge;

means for overlapping said lip means, said overlapping means reducing wear of said lip means at least by reducing contact between said lip means and said abrasive material;

means attached to said lip means and said overlapping means for biasing said overlapping means against said forward edge, said biasing means comprising a fastener, said fastener being capable of applying said force to bias said overlapping means against said forward edge, said fastener being an elongated externally threaded member, said biasing means further comprising an internally threaded member, said internally threaded member being tightened onto said externally threaded member to apply said force to bias said overlapping means against said forward edge, and a retainer attached to said lip means, said retainer having a rearwardly facing surface formed thereon, said surface being orthogonal to one of said top and bottom sides, said externally threaded member being received in a first recess formed on said retainer with said internally threaded member applying said force to said surface when said internally threaded member is tightened onto said externally threaded member;

means attached to said biasing means for resiliently maintaining a force biasing said overlapping means against said lip means, such that said force is maintained when wear is produced between said overlapping means and said lip means; and means, formed on said overlapping means and said retainer, for restricting lateral movement of a rear portion of said overlapping means relative to said lip means.

16. The excavating apparatus according to claim 15, wherein said restricting means comprises an outwardly projecting side portion formed on said retainer and a complementarily shaped second recess internally formed on said overlapping means, said side portion being received in said second recess.

17. The excavating apparatus according to claim 16, wherein said second recess provides a laterally inwardly disposed cavity laterally intermediate said retainer and said overlapping means, such that said retainer is permitted to laterally inwardly displace relative to said overlapping means when said overlapping means and said lip means wear.

18. The excavating apparatus according to claim 15, wherein said resiliently maintaining means comprises an axially compressible structure disposed intermediate said internally threaded member and said surface, said axially compressible structure being axially compressed when said internally threaded member is tightened onto said externally threaded member.

19. For an excavating device having an earth penetrating lip, the lip having a top surface, a bottom surface, and a front edge, and one of the top and bottom surfaces having a retainer mounted thereto, the retainer having a lateral side portion, wear resistant attachment apparatus comprising:

a generally C-shaped body having a profile internally formed thereon and a fastener attachment portion, said profile being shaped to forwardly and complementarily receive the lip therein;

a fastener having opposite ends, one of said opposite ends being attached to said fastener attachment portion and the other of said opposite ends being attachable to the retainer;

a resilient biasing member attached to said fastener and capable of biasing said profile to contact the lip when said fastener is attached to the retainer;

a forwardly to rearwardly extending recess formed in one of said profile and said lateral retainer side portion; and a forwardly to rearwardly extending projection formed in the other of said profile and said lateral retainer side portion, said projection being slidably receivable in said recess and operative to restrict displacement of said body relative to the lip when said fastener is attached to the retainer.

* * * * *